US006681816B2

(12) United States Patent
Mie

(10) Patent No.: US 6,681,816 B2
(45) Date of Patent: Jan. 27, 2004

(54) DEVICE FOR INJECTING A PRODUCT AT A PREDETERMINED LOCATION OF A MOVING OBJECT

(75) Inventor: Patrick Mie, Le Havre Cedex (FR)

(73) Assignee: Sidel, Le Havre Cedex (FR)

( * ) Notice: Subject to any disclaimer, the term of this patent is extended or adjusted under 35 U.S.C. 154(b) by 0 days.

(21) Appl. No.: 10/182,404

(22) PCT Filed: Jan. 23, 2001

(86) PCT No.: PCT/FR01/00209

§ 371 (c)(1),
(2), (4) Date: Jul. 30, 2002

(87) PCT Pub. No.: WO01/60536

PCT Pub. Date: Aug. 23, 2001

(65) Prior Publication Data

US 2003/0000969 A1 Jan. 2, 2003

(30) Foreign Application Priority Data

Feb. 16, 2000 (FR) ..... 00 01872

(51) Int. Cl.[7] ..... B65B 1/04
(52) U.S. Cl. ..... 141/184; 141/137; 141/135
(58) Field of Search ..... 141/250, 270, 141/279, 283, 284, 184, 185, 144, 137, 135, 129

(56) References Cited

U.S. PATENT DOCUMENTS

| | | | | |
|---|---|---|---|---|
| 3,129,713 A | | 4/1964 | Dostal ?Lowey Co. | |
| 4,004,620 A | * | 1/1977 | Rosen | 141/137 |
| 4,159,608 A | * | 7/1979 | Masuda et al. | 53/282 |
| 4,678,015 A | * | 7/1987 | Raque et al. | 141/131 |

* cited by examiner

*Primary Examiner*—Steven O. Douglas
(74) *Attorney, Agent, or Firm*—Sughrue Mion, PLLC

(57) ABSTRACT

A device for injecting a product towards a predetermined site of objects continuously moving along a given path while being spaced apart from one another by a specific step. The device (10) includes a series of injectors (26) borne by a mobile support (28) while being spaced apart on the support by a pitch corresponding to that of the objects, and the support (28) is driven in a reciprocating movement such that, during a forward phase of the movement, the injectors (26) move each opposite the predetermined site of one of the objects, and in the time interval of the reciprocating movement of the support is equal to the time interval between the passage of two consecutive objects in front of a common fixed point, multiplied by the number of injectors on the support.

21 Claims, 5 Drawing Sheets

DEVICE FOR INJECTING A PRODUCT AT A PREDETERMINED LOCATION OF A MOVING OBJECT

The invention more particularly concerns facilities for manufacturing and/or processing and/or filling hollow bodies.

By way of example, the invention will be described within the scope of a facility for manufacturing and/or filling containers made of thermoplastic material. More particularly, the device according to the invention will be described within the scope of a machine for manufacturing polyethylene terephtalate (PET) bottles in which the bottles are obtained by blow-molding a preform that has first been produced by injection molding.

In such facilities, it is often necessary, at one point or another in the process of manufacturing, processing or filling, to inject a product into a hollow body. For example, in a bottle manufacturing or filling unit, this product can be a sterilizing agent.

These facilities generally operate continuously, the hollow bodies all following the same path in the facility, moving continuously one after the other. This continuous nature of the movement of the hollow bodies poses a problem with respect to injecting into each hollow body a product such as a sterilizing agent. Indeed, there are generally two solutions.

According to one of these solutions, the simplest one, the product is injected by a nozzle placed in each hollow body when the hollow body in question passes in front of the nozzle. However, in high speed facilities, the length of time the hollow body is in front of the nozzle is extremely short, making it difficult to spray a sufficient amount of product under good spraying conditions, particularly when it is desired to ensure a good distribution of the product injected into the hollow body. In order to inject the desired amount of product, the flow rate of product must be increased, with the consequent loss of good control of the jet. The spray could also be begun early and its ending delayed, at the risk of part of the product not being injected into the hollow body, which causes wastage of product and fouling of the outside of the hollow body and the machine.

Another solution would consist of using a specific machine similar to a rotary filling machine. However, the cost of such a solution would be much too high.

A purpose of the invention, therefore, is to propose a new design of an injection device that is simple and reliable, and which allows a product to be injected into a moving hollow body, the conditions of injection of the product being perfectly controlled.

To that end, the invention proposes a device for injecting a product toward a predetermined location of objects that are moving continuously along a given path while being spaced from each other at a specific distance, characterized in that the device has a series of injectors that are carried by a movable support while being spaced on the support at a distance corresponding to that of the objects, in that the support is driven in a reciprocal movement so that, during an outbound phase of the movement the injectors are each moved in front of the predetermined location of one of the objects, and in that the period of the reciprocal movement of the support is equal to the time interval between the passage of two consecutive objects before a same fixed point, multiplied by the number of injectors on the support.

According to other characteristics of the invention:

- during the outbound phase of the movement, the injectors are moved parallel to and at the same speed as the objects;

- the reciprocal movement of the support has, in addition to the outbound phase, a return phase during which the movement is in the reverse direction, and two reversal phases;
- the duration of the four phases of movement are of the same order of magnitude;
- all along the reciprocal movement, the path of the injectors remains parallel to the path of the objects;
- the path of the injectors is a semicircular arc;
- the device has a transfer wheel that is driven in continuous rotational movement around its axis and on which are loaded the objects along one part of their path, and the injectors follow a path in an arc of circle around the same axis;
- the reciprocal movement of the movable support is controlled by a system having a movable cam and a cam follower connected to the support;
- the cam is a rotary cam that is driven in continuous rotational movement;
- the cam is driven in a continuous rotational movement around an axis parallel to the axis of rotation of the support;
- the cam has the form of a plate the contour of which forms the cam path;
- the cam follower is pressed against the cam by elastic return means;
- the device has a second cam that cooperates with a second cam follower connected to the support, and the profiles of the two cams are complementary so as to ensure positive control of the support in both directions of its reciprocal movement;
- at least one of the two cam followers has elastic means suitable for compensating for the geometric imperfections of the device;
- it has a plate in which a track is formed with two parallel edges in which a roller moves that is connected to the support and which can cooperate with each of the edges of the track, these two edges each forming a cam path to ensure positive control of the support in both directions of its travel;
- the cam is driven in rotation by the transfer wheel through a reduction gear;
- the objects are hollow bodies having one opening; and
- the injectors are provided to inject a product into the hollow bodies.

Other characteristics and advantages of the invention will appear from the following detailed description, as well as from the attached drawings in which.

Figure 1:
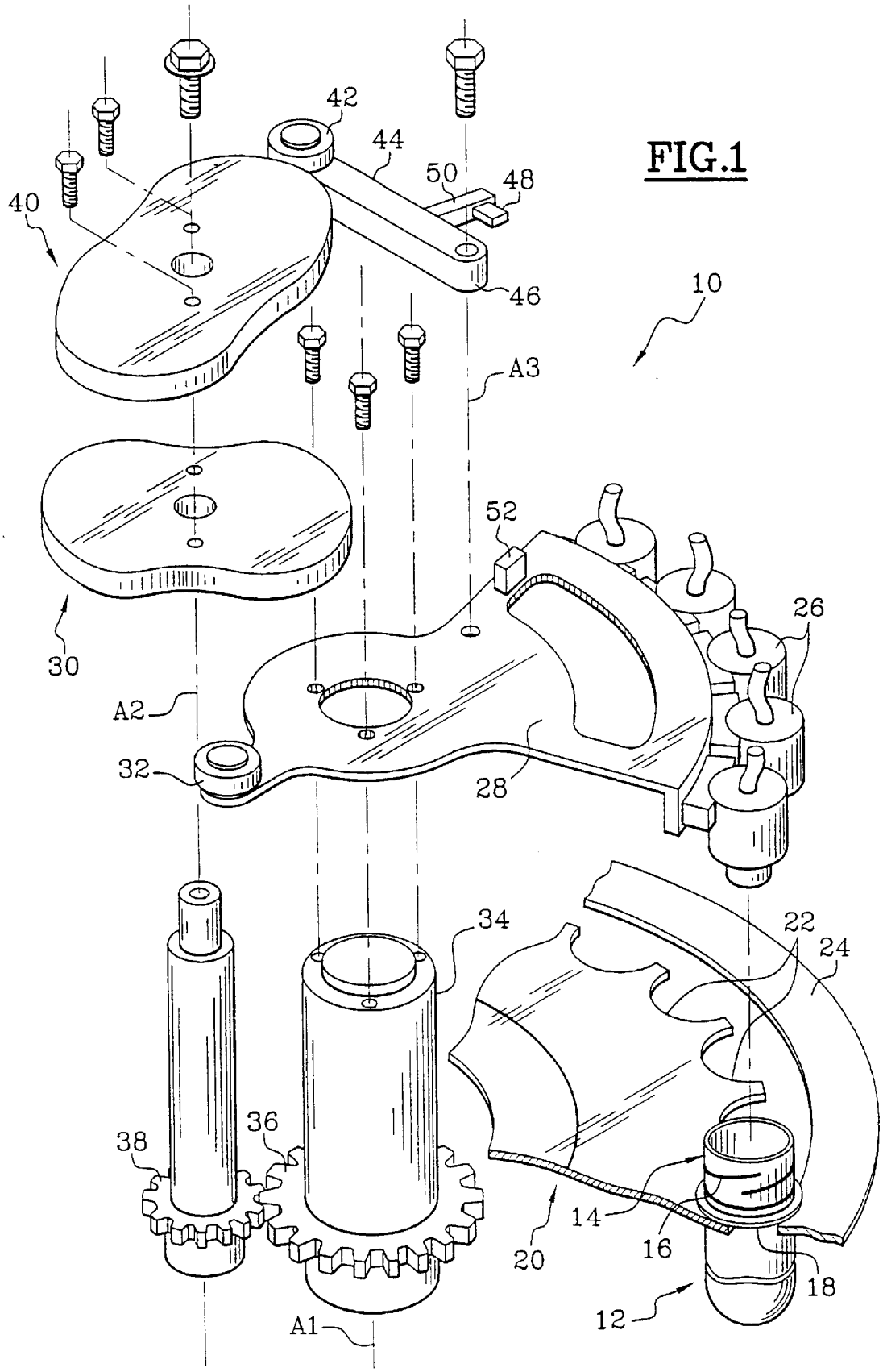
FIG. 1 is a diagrammatical exploded view in perspective of the device according to the invention.
Figure 2:
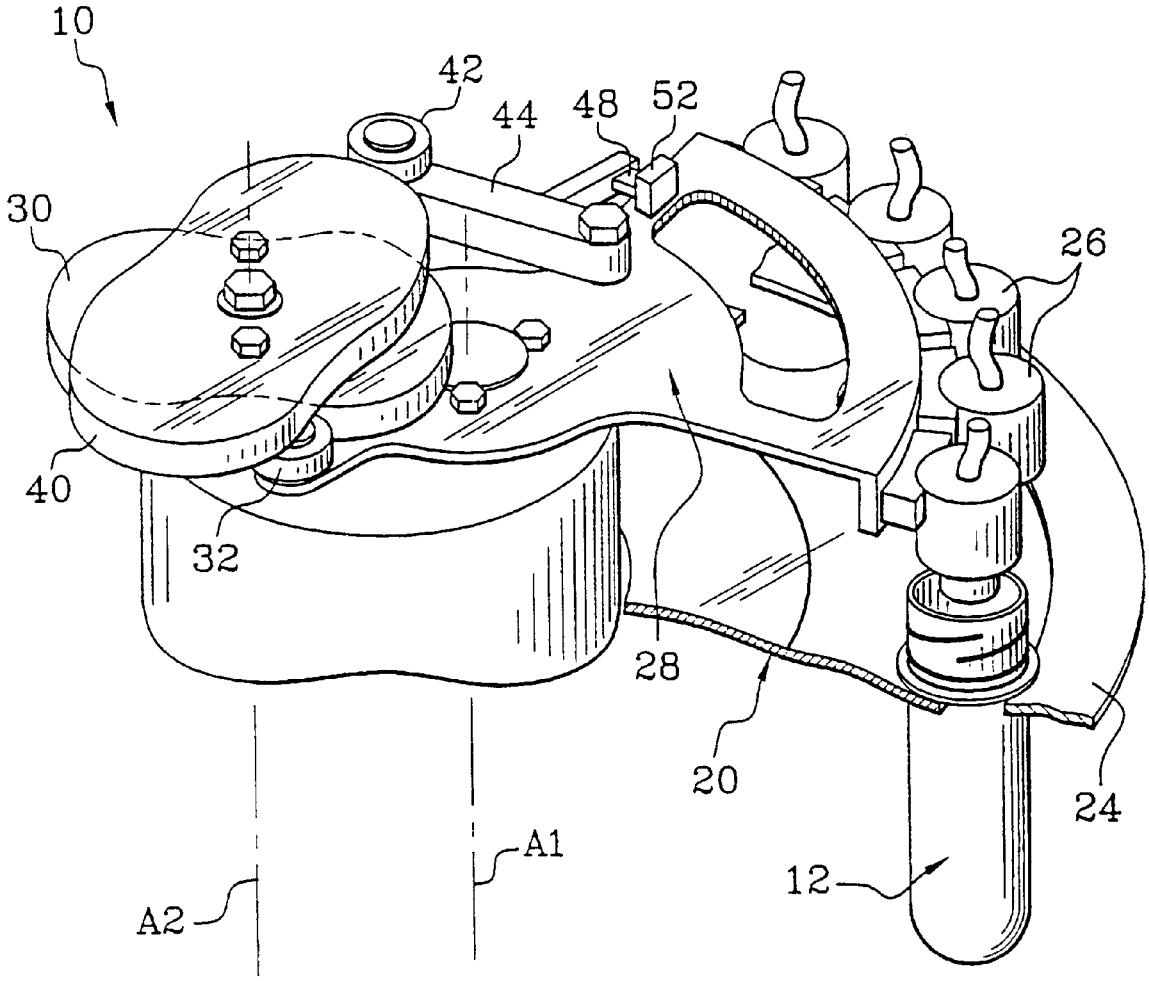
FIG. 2 is a diagrammatical view in perspective of the device of FIG. 1, after assembly.

and FIGS. 5A to 5F are schematic diagrams illustrating different successive positions of the device during operation.

The invention will be described within the scope of a device 10 for injecting a sterilizing agent such as hydrogen peroxide ($H_2O_2$) or peracetic acid (APA) inside preforms 12 intended to be manufactured into PET bottles. The preforms are hollow bodies produced by injection molding. These are generally appreciably tubular in shape and have one closed end and one open end. The open end 14, which is intended to form the open neck of the final container, is generally produced directly in its final form in the injection mold, and has, for example, threading 16 and an external radial collar 18.

In many bottle manufacturing facilities, the preforms are transported to the stretch blow molding machine by a positive transfer system in which the preforms continuously follow a defined path while being spaced from each other at a determined rate. This positive transfer system has, for example, a wheel 20 with recesses that is driven in continuous rotation around its appreciably vertical axis A1.

In this instance, the wheel 20 has, at its periphery, twenty semicircular recesses 22, the diameter of each being appreciably equal to that of the individual preforms. In a known way, the preforms 12 are placed on the wheel 20 at a loading point so that each is received into a recess, and so that each is supported by its collar 18 on the wheel 20. Downstream from the point of loading, a guide 24 shaped in the arc of a circle and appreciably tracking axis A1 extends around the wheel 20 to form another support area for the preforms 12 and to prevent them from escaping the recess 22. Thus, while the preforms 12 are on the wheel 20, they follow a path in an arc of a circle around the axis A1, up to the point of unloading at which they leave the wheel 20 to continue being transferred by other means.

In a bottle manufacturing facility, this type of wheel with recesses can be, for example, positioned between a preform feed device and a temperature conditioning oven in which the preforms are brought up to a temperature at which they can be blow-molded.

According to the principles of the invention, the device 10 has several injectors 26 that are carried by a movable support 28. In the example illustrated, there are five injectors 26 carried by a plate-like support 28 that is movable in rotation around the axis A1 and which is positioned above the wheel 20. On the support 28, the injectors 26 are positioned on an arc of a circle around the axis A1, the diameter of which corresponds to the diameter of the wheel with recesses, and they are spaced from each other along this arc at a distance corresponding to the distance separating two consecutive recesses 22 of the wheel 20.

As a result, depending on the relative angular positions of the wheel 20 and the support 28 around the axis A1, the five injectors 26 can inject the product into five preforms carried by the wheel 20.

According to the invention, the support 28 is controlled in an alternating rotational movement around the axis A1, the control of the movement being such that, during at least one phase of this movement, the injectors 26 exactly follow the transport movement of the preforms that are carried on the wheel 20.

In the example illustrated, the alternating movement of the support 28 is controlled by a system of two cams.

Thus, the device has a first cam 30 in the form of a plate with a contour that forms a cam path. The cam 30 is designed to be driven in rotation around a central axis A2 which, in the example illustrated, is parallel to the axis A1 but different therefrom. The movable support 28 has a first cam follower 32 in the form of a roller, for example, and which is designed to roll along the edge of the first cam.

Figure 3:
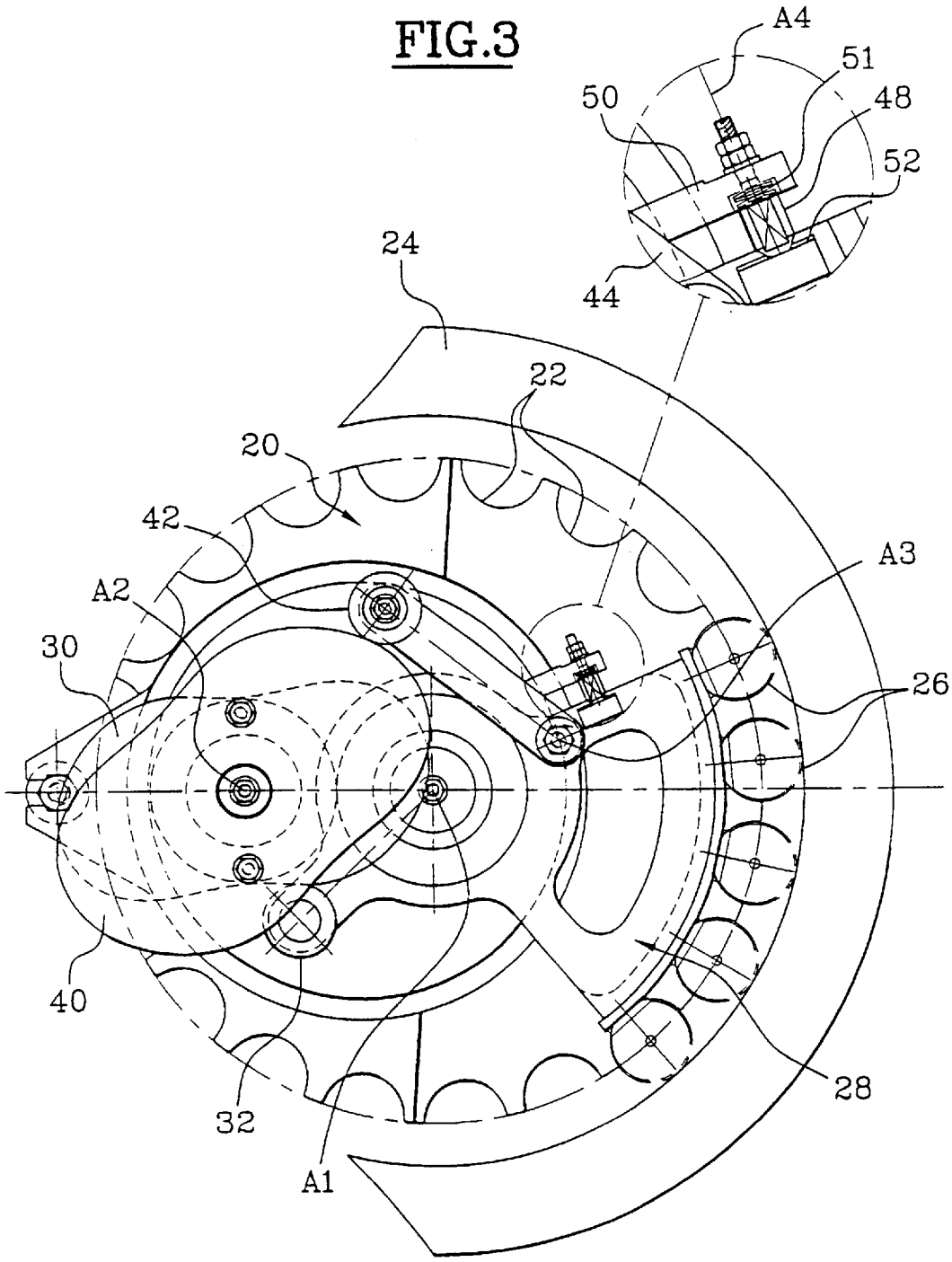
FIG. 3 is a diagrammatical top view of the device.
Figure 4:
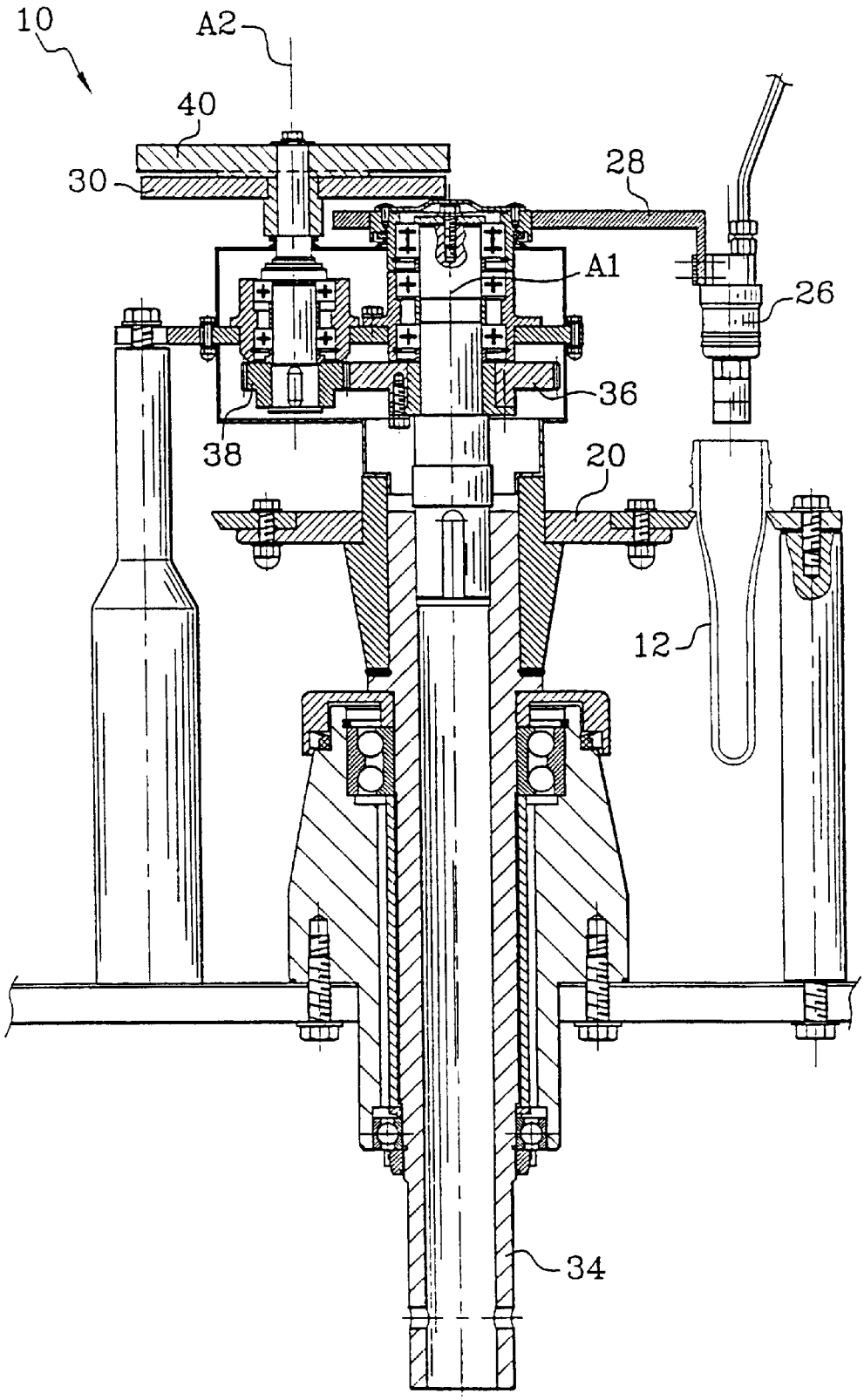
FIG. 4 is a partial view in axial cross section.

The first cam 30 is designed to be driven in rotation by the same shaft 34 that drives the wheel 20 with recesses, by means of a pair of gears 36, 38 that are sized so that the cam 30 turns twice as fast around its axis A2 as the wheel 20 around its axis A1, the directions of rotation being opposite to each other. As can be seen in FIG. 3, the cam 30 is symmetrical around its axis A2 in the sense that two points of the edge of the plate that are diametrically opposite with respect to the axis A2 are situated at an equal distance from the axis A2.

The cam follower 32 is designed to remain permanently pressed against the cam path formed by the edge of the first cam 30. This could be accomplished by a system of elastic recall, for example a spring placed between the movable support 28 and a fixed element of the frame to force the roller 32 against the cam.

In the example illustrated, it was preferred to provide a second cam 40, which is integral with the first cam 30, that has a profile that is complementary to the first cam 30, and which is designed to cooperate with a second cam follower 42 connected to the support 28. The second cam 40 is therefore also driven in rotation around the axis A2, the profile of this second cam also being symmetrical with respect to the axis A2.

It is useful, in order to take into account the dimensional tolerances related to the manufacture and assembly of the device, for the second cam follower 42 not to be rigidly connected to the support 28. Thus, the second cam follower 42 is carried at one end of a lever 44 that is mounted in rotation by its other end 46 on the movable support 28. The axis of rotation A3 of the lever 44 with respect to the support 28 is parallel to the axes A1 and A2. The lever 44 has a projection 50 on which is mounted a stop finger 48 that can slide along its axis A4 with respect to the projection 50. However, this sliding possibility is limited and the finger is pushed toward a rest position by a stack of Belleville type elastic washers 51. This finger 48 is intended to press against a stop surface 52 of the support 28, this surface being positioned on the support so as to force the second cam follower 42 against the second cam 40.

In this way, the action of the second cam 40 forces the support 28 in a direction opposite to that of the first cam 30. Thus, the two cams 30, 40 and the two cam followers 32, 42 are arranged in such a way that they are each forced against the cam followers, so that the angular position of the movable support 28 is always perfectly defined, regardless of the angular position of the two cams. The sliding finger 48 and the elastic washers 51 make it possible to eliminate backlash during operation.

The two-cam system can also be replaced by a system having a single cam in the form of a plate in one face of which a closed loop groove would be hollowed out. The groove would have two opposite parallel edges that would allow a cam follower connected to the support to be guided in both directions of the reciprocal movement.

In this instance, the choice was made for the cams 30, 40 to have an axis of rotation A2 parallel to but different from the axis A1 of rotation of the support 28. This arrangement makes it possible to use a particularly simple system to drive the cams. As a variation, however, a rotary cam with the same axis A1 as the support 28 could be used.

The operation of the device described above will now be explained, with reference to the diagrams in FIGS. 5A to 5F. These diagrams illustrate the wheel 20 with recesses, and on this wheel, two series 12*a* and 12*b* of preforms engaged in consecutive recesses of the wheel 20. Of course, the wheel 20 is driven in continuous rotation around its axis A1, in this instance in the counterclockwise direction in FIGS. 5A to 5F.

Figure 5A:
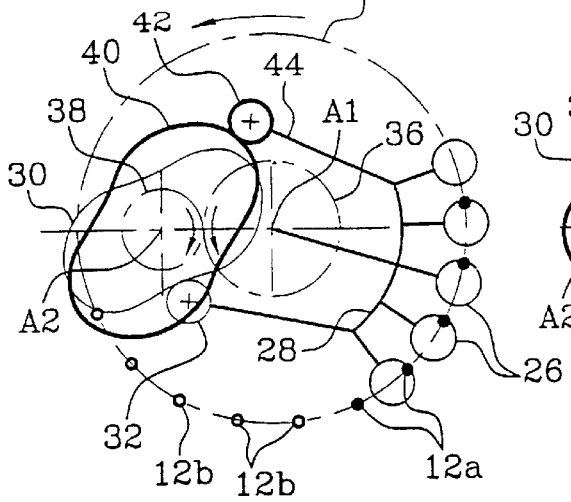

FIG. 5A corresponds to an angular position of the cams 30, 40 around their axis A2 for which the support is in one extreme position. With respect to the direction of rotation of the wheel 20, and therefore to the direction of movement of the preforms 12 carried by the wheel 20, this position will be deemed to be the extreme upstream position. This extreme upstream position corresponds to a point of reversal of the reciprocal movement of the support 28, the speed of the support at this point being zero. In this position, the first series of preforms 12*a* is offset in the upstream direction compared to the injectors 26 carried by the support.

Figure 5B:
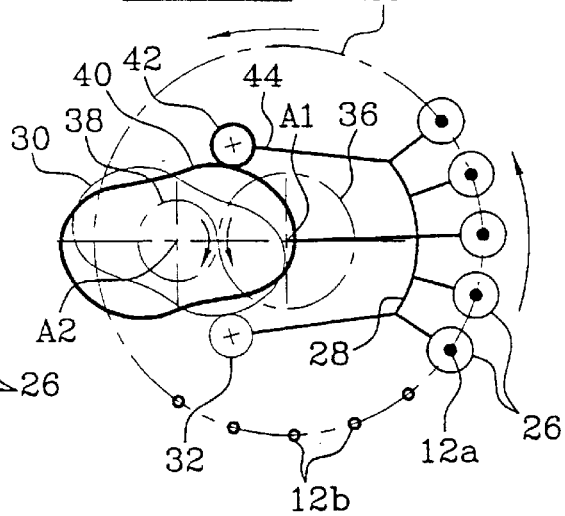
Figure 5C:
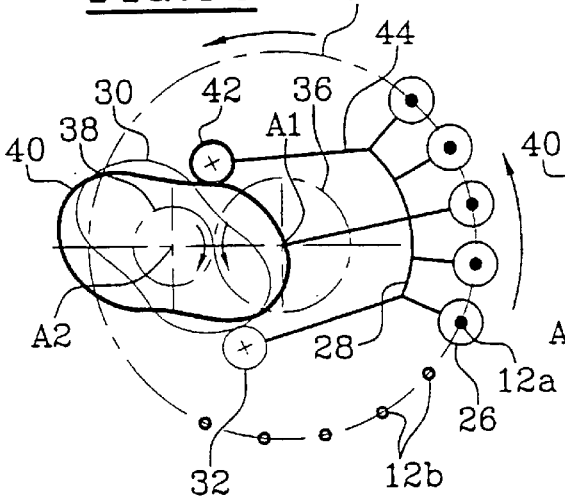

In the position of FIG. 5B, the wheel 20 has pivoted twenty degrees in the counterclockwise direction with respect to the extreme upstream position. By the arrangement of the gears 36, 38, the cams 30, 40 have turned around the axis A2 by an angle twice as large, and in the opposite direction. It will be noted that the two cam followers 32, 42 are each in contact with the cam with which they are respectively associated. In this position, the five injectors 26 carried by the support 28 are exactly in line with the five preforms 12*a* of the first series. This means that, between the positions of the FIGS. 5A and 5B, the preforms have "caught up with" the injectors 26. In effect, this phase of the movement of the support 28 corresponds to a progressive acceleration of the support from a speed of zero to an angular speed appreciably equal to the speed of the wheel 20.

The position of the support illustrated in FIG. 5B marks the beginning of a tracking phase during which, for a certain period of time, the wheel 20 and the support 28 have appreciably the same speed. In this way, all along this phase of the movement, the injectors are moved so as to be placed just above the preforms in order to inject a product into them. This tracking phase continues up to the end-of-tracking position illustrated in FIG. 5C, in which the injectors 26 are still in line with the preforms 12*a*, even though these preforms have continued their movement connected to the rotation of the wheel 20.

The duration of this tracking phase can be adjusted as needed, of course, by an appropriate design of the cams 30, 40.

Figure 5D:
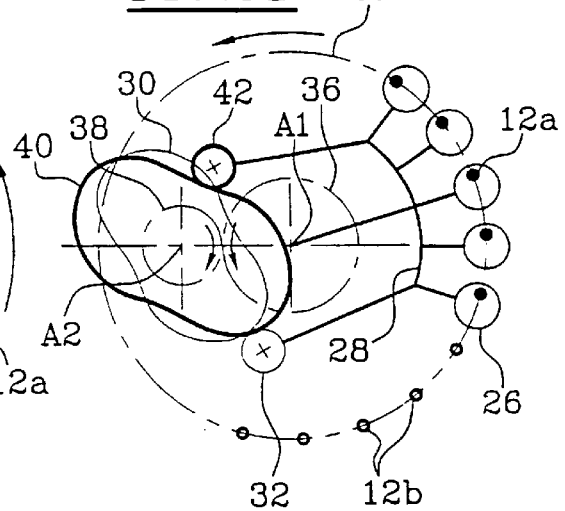
Figure 5E:
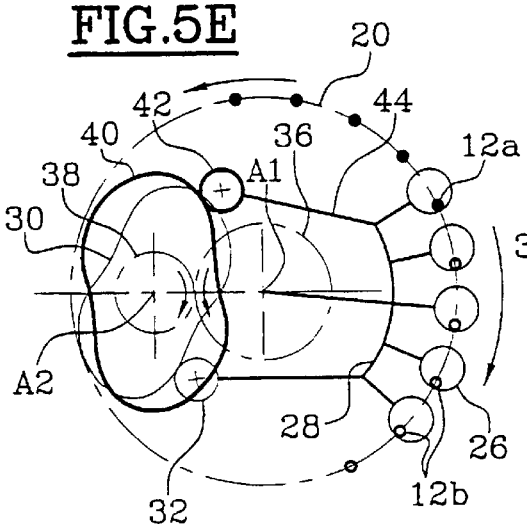

FIG. 5D illustrates the extreme downstream position of the support 28. Between the positions of FIGS. 5C and 5D, the support has progressively slowed so that, in the position of FIG. 5D it has zero speed. In effect, the preforms 12*a* of the first series are now offset toward the downstream position with respect to the series of injectors 26. This position therefore corresponds to a second point of reversal of the reciprocating movement of the support 28.

Between FIGS. 5A and 5D, the support is driven in rotation essentially as a result of the first cam 30 which tends to push the first cam follower 32 to make the support pivot in the counterclockwise direction.

Figure 5F:
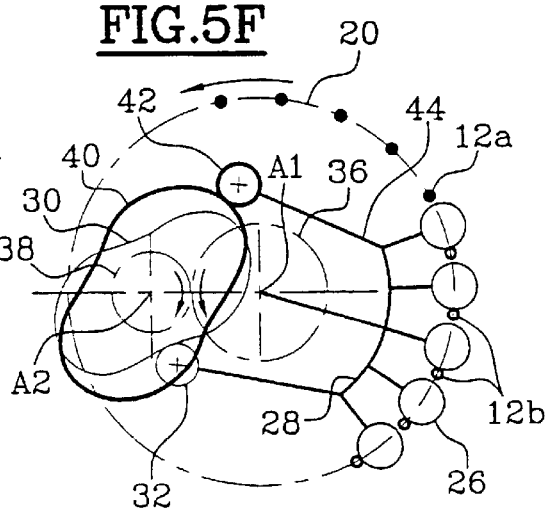

Starting in the position of FIG. 5D and up to the position of FIG. 5F, it is the second cam 40 that, by means of the second cam follower 42, causes the support 28 to return to its extreme downstream position as illustrated in FIG. 5F. During the return, the support first undergoes a progressive acceleration, then a progressive deceleration to arrive at its extreme downstream position at which it has zero speed. At that moment, the second series of preforms 12*b* occupies, with respect to the support 28, the same position as the preforms 12*a* of the first series in FIG. 5A.

Between these two positions, the wheel 20 has made one fourth of a turn, which corresponds to five times the angular spacing between two successive recesses. In other words, the length of time that separates the passage of the support from its position of FIG. 5A to that of FIG. 5F, which corresponds to one period of reciprocal movement of the support 28, is therefore equal to the time required for five preforms to pass in front of a fixed point in their trajectory on the wheel 20.

The cams 30, 40 have made one half turn during that same time, and because their profile has a central symmetry with respect to the axis A2, the operation of the device can then be continued in a way similar to what was described above, the injectors 26 then tracking with the preforms 12*b* of the second series.

As a result of the device according to the invention, there is sufficient spraying time, without stopping or slowing the preforms, while the preforms are being processed.

In the example illustrated, the length of the outbound stage of the movement, which corresponds to the time during which the product can be sprayed in the moving objects, only represents about one fourth to one third of the total time of one complete cycle of movement. Of course, by an appropriate design of the cams, this ratio could easily be varied, but as it is, it makes it possible to have reversal stages that do not impose sudden changes of speed on the support. This advantage assumes that the durations of the outbound stages and return stages of the movement are of the same order of magnitude, that is, the ratio between the duration of the stage and the shortest duration is less than 10.

As can be seen, the amplitude of the reciprocating movement of the support 28 is relatively limited, so the injectors 26 can be fed with product by a fixed tank attached to the injectors by one or more flexible lines. Such an arrangement is therefore much simpler that a rotary distributor.

The invention has been described within the particular scope of spraying a sterilizing product into a preform intended for the manufacture of containers.

It is evident, however, that the invention can be used in other applications. Thus, a device incorporating the principles of the invention can be used for processing other objects, such as bottle stoppers. It can also be used to process other predetermined locations of an object, for example such as the outer threaded part of the neck of a preform or bottle.

What is claimed is:

1. A device for injecting a product toward a predetermined location of objects that are moving continuously along a given path while being spaced from each other at a specific distance, characterized in that the device has a series of injectors that are carried by a moveable support while being spaced on the moveable support at a distance corresponding to that of the objects, in that the moveable support is driven in a reciprocal movement so that, during an outbound phase of the movement the injectors are each moved in front of the predetermined location of one of the objects, and in that period of the reciprocal movement of the moveable support is equal to the time interval between the passage of two consecutive said objects before a same fixed point, multiplied by the number of injectors on the support.

2. The device according to claim 1, characterized in that during the outbound phase of the movement, the injectors appreciably track the movement of the objects.

3. The device according to claim 1, characterized in that the reciprocal movement of the moveable support has, in addition to the outbound phase, a return phase during which the movement is in the reverse direction, and two reversal phases.

4. The device according to claim 3, characterized in that the duration of the four phases of movement are of the same order of magnitude.

5. The device according to claim 1, characterized in that all along the reciprocal movement, the path of the injectors remains parallel to the path of the objects.

6. The device according to claim 5, characterized in that the path of the injectors is a semicircular arc.

7. The device according to claim 1, characterized in that the device has a transfer wheel that is driven in continuous rotational movement around its axis and on which are loaded the objects along one part of their path, and in that the injectors follow a path in a semicircular arc around the same axis.

8. The device according to claim 1, characterized in that the reciprocal movement of the movable support is controlled by a system having a movable cam and a cam follower connected to the moveable support.

9. The device according to claim 8, characterized in that the cam is a rotary cam that is driven in continuous rotational movement.

10. The device according to claim 9, characterized in that the cam is driven in a continuous rotational movement around the same axis of rotation of the moveable support.

11. The device according to claim 9, characterized in that the cam is driven in a continuous rotational movement around an axis parallel to an axis of rotation of the moveable support.

12. The device according to claim 9, characterized in that the cam has the form of a plate the contour of which forms the cam path.

13. The device according to claim 12, characterized in that the cam follower is pressed against the cam by elastic return means.

14. The device according to claim 12, characterized in that the device has a second cam that cooperates with a second cam follower connected to the moveable support, and in that the profiles of the two cams are complementary so as to ensure positive control of the moveable support in both directions of its reciprocal movement.

15. The device according to claim 14, characterized in that at least one of the two cam followers has elastic means suitable for compensating for the geometric imperfections of the device.

16. The device according to claim 12, characterized in that it has a plate in which a track is formed on two parallel edges in which a roller moves that is connected to the moveable support and which can cooperate with each of the edges of the track, these two edges each forming a cam path to ensure positive control of the moveable support in both directions of its travel.

17. The device according to claim 9, characterized in that the cam is driven in rotation by a transfer wheel through a reduction gear.

18. The device according to claim 1, characterized in that the objects are hollow bodies having one opening.

19. The device according to claim 18, characterized in that the injectors are provided to inject a product into the hollow bodies.

20. The device of claim 2, further wherein at the end of the outbound phase of the reciprocal movement, the injectors appreciably stop movement and tracking of the objects; and in an inbound phase of the reciprocal movement, the injectors move in a direction opposite to the objects with a speed that varies in accordance with irregular lengths in the sides of a cam.

21. A device for injecting a product toward a predetermined location of objects that are moving continuously along a periphery of an axis of rotation while being held on a transfer wheel;

the device characterized by a series of injectors that are carried by a moveable support, wherein the moveable support is driven in a reciprocal movement comprising an outbound and inbound phase, the outbound and inbound phases characterized by time periods of substantially identical lengths; and wherein the injectors appreciably track the objects during the outbound phase of the reciprocal movement.

* * * * *